US009001000B2

(12) United States Patent
Satou et al.

(10) Patent No.: US 9,001,000 B2
(45) Date of Patent: Apr. 7, 2015

(54) ANTENNA

(75) Inventors: Hiroshi Satou, Kanagawa (JP); Yoshio Koyanagi, Kanagawa (JP); Takanori Hirobe, Ishikawa (JP); Hiroyuki Uejima, Ishikawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 246 days.

(21) Appl. No.: 13/821,368

(22) PCT Filed: May 16, 2012

(86) PCT No.: PCT/JP2012/003213
§ 371 (c)(1),
(2), (4) Date: Mar. 7, 2013

(87) PCT Pub. No.: WO2012/157274
PCT Pub. Date: Nov. 22, 2012

(65) Prior Publication Data

US 2013/0162497 A1 Jun. 27, 2013

(30) Foreign Application Priority Data

May 19, 2011 (JP) ..... 2011-112274

(51) Int. Cl.
*H01Q 21/00* (2006.01)
*H01Q 5/00* (2006.01)
(Continued)

(52) U.S. Cl.
CPC ..... *H01Q 5/0058* (2013.01); *H01Q 21/28* (2013.01); *H01Q 21/0006* (2013.01); *H01Q 1/243* (2013.01); *H01Q 5/0048* (2013.01); *H01Q 9/30* (2013.01); *H01Q 1/521* (2013.01)

(58) Field of Classification Search
CPC ... H01Q 1/243; H01Q 5/0048; H01Q 5/0058; H01Q 1/521; H01Q 21/28; H01Q 21/0006; H01Q 9/30
USPC ..... 343/702, 850, 852, 853
See application file for complete search history.

(56) References Cited

U.S. PATENT DOCUMENTS 8,508,420 B2 * 8/2013 Fujieda et al. ..... 343/745
2008/0278405 A1 * 11/2008 Montgomery et al. ..... 343/893
(Continued)

FOREIGN PATENT DOCUMENTS

WO 2011/102143 A1 8/2011
WO 2011/142135 A1 11/2011

OTHER PUBLICATIONS

Chen et al., "A Decoupling Technique for Increasing the Port Isolation Between Two Strongly Coupled Antennas," IEEE Transactions on Antennas and Propagation, 56(12):3650-3568, Dec. 2008.
(Continued)

*Primary Examiner* — Hoanganh Le
(74) *Attorney, Agent, or Firm* — Seed IP Law Group PLLC

(57) ABSTRACT

A first antenna element is embodied in a blanched structure, and a second antenna element is embodied in a blanched structure. A low coupling circuit for increasing susceptance with an increase in frequency is interposed between the first antenna element and the second antenna element. The first antenna element and the second antenna element exhibit resonance of a Y12 component of an admittance matrix between first and second frequencies and between second and third frequencies. The first branch element and the third branch element assume a value of nearly a quarter of a resonant electrical length of the Y12 component of the admittance matrix between the first and second frequencies. The second branch element and the fourth branch element assume a value of nearly a quarter of the resonant electrical length of the Y12 component of the admittance matrix between the second and third frequencies.

6 Claims, 24 Drawing Sheets

(51) Int. Cl.

| | |
|---|---|
| ***H01Q 21/28*** | (2006.01) |
| ***H01Q 1/24*** | (2006.01) |
| ***H01Q 9/30*** | (2006.01) |
| ***H01Q 1/52*** | (2006.01) |

(56) References Cited

U.S. PATENT DOCUMENTS

| | | | | |
|---|---|---|---|---|
| 2010/0156726 | A1* | 6/2010 | Montgomery et al. | 343/700 MS |
| 2010/0265146 | A1 | 10/2010 | Montgomery et al. | |
| 2012/0127055 | A1* | 5/2012 | Yamagajo | 343/850 |

OTHER PUBLICATIONS

Endo et al., "An Array Antenna for MIMO System with a Decoupling Network Using Bridge Susceptances," IEICE Technical Report 110(446):43-48, AP2010-181(2011-3), Feb. 24, 2011.

Sato et al., "Study on Antenna Efficiency Improvement of Two Closely Spaced Monopole Antenna Elements," IEICE Technical Report 110(347):1-5, AP2010-118, Dec. 2010.

International Search Report, mailed Aug. 14, 2012, for PCT/JP2012/003213, 4 pages.

* cited by examiner (a)

(b)

ANTENNA

TECHNICAL FIELD

The present invention relates to an antenna suitable for use with a multi-band-compatible mobile terminal.

BACKGROUND ART

In order to make recent mobile terminals conform to a bulk data transmission system, use of a plurality of antenna elements has been studied. Since 800 MHz, 1.5 GHz, 1.7 GHz, and 2.0 GHz bands are used even for a current cellular transmission method, development of an antenna capable of conforming to the multi-band has been expected. When a compact mobile terminal is equipped with a plurality of antenna elements, a high degree of isolation among antenna elements must be assured so as not to deteriorate coupling between the antenna elements. In particular, even when there are adopted measures to prevent deterioration of coupling among antenna elements, the measures will not make sense if antenna efficiency becomes worse when the mobile terminal is held by hand (in other words, when the mobile terminal is kept in hand). For these reasons, a low coupling technique that suppresses deterioration of antenna efficiency even in such a case has been sought.

Patent Document 1 discloses a technique for effecting low coupling of two antenna elements with a junction element, such as a filter, interposed therebetween. Non-Patent Document 1 discloses a technique for setting two concentrated constants on a two-element monopole antenna having one resonance frequency, thereby effecting low coupling at a maximum of two frequencies.

RELATED ART DOCUMENT

Patent Document

Patent Document 1: US Patent Laid-open Disclosure Number 2010/0265146

Non-Patent Document

Non-Patent Document 1: Technical Report published by IEICE (The Institute of Electronics, Information and Communication Engineers), Vol. 110, No. 347, AP2010-118, pp. 1-5 "Improvement of Antenna Efficiency of Closely-Arrayed Two-element Low-coupled Antenna"

SUMMARY OF THE PRESENT INVENTION

Problem that the Present Invention is to Solve

However, under the technique disclosed in Patent Document 1, low coupling can be affected only at one frequency. If an attempt is made to cause the antenna to comply with multiple frequencies, there will be encountered problems; namely, (1) an increase in circuit scale due to addition of switches and filters and (2) the inability to simultaneously use multiple frequencies under a switching method. Further, the technique does not bear any considerations to repercussions on antenna efficiency which will arise when impediments exist around an antenna during low coupling, such as those occurring in a hand-held state.

The technique disclosed in Non-Patent Document 1 enables low coupling at two frequencies. However, when the antenna is caused to comply with three frequencies, there is a necessity for switching a low coupling circuit with changeover means, such as a switch, which in turn raises a problem of an increase in circuit scale.

The present invention has been conceived in light of the circumstance and aims at providing an antenna capable of complying with three frequencies without involvement of an increase in circuit scale and suppressing deterioration of antenna efficiency due to impediments.

Means for Solving the Problem

An antenna of the present invention comprises: a circuit board having a ground pattern; a first antenna element that is made of conductive metal and that has a first branch element and a second branch element having a shorter electrical length than that of the first branch element; and a second antenna element that is made of conductive metal and that has a third branch element and a fourth branch element having a shorter electrical length than that of the third branch element, wherein the first antenna element and the second antenna element are placed in proximity to each other while spaced apart from the ground pattern of the circuit board at a predetermined interval and are electrically connected to a first power feeding part and a second power feeding part placed on the circuit board, by a first matching part and a second matching part; wherein the antenna has a low coupling circuit that electrically connects a portion of the first antenna element to a portion of the second antenna element, the first matching part to the second matching part, or the first power feeding part to the second power feeding part and that conforms to a plurality of desired frequencies; wherein, when the plurality of desired frequencies are taken as a first frequency, a second frequency, and a third frequency in ascending order from a low frequency to a higher frequency, the first antenna element and the second antenna element exhibit resonance of a Y12 component of an admittance matrix between the first frequency and the second frequency and between the second frequency and the third frequency; wherein the first branch element and the third branch element assume a value of nearly a quarter of a resonant electrical length of the Y12 component of the admittance matrix between the first frequency and the second frequency; and wherein the second branch element and the fourth branch element assume a value of nearly a quarter of a resonant electrical length of the Y12 component of the admittance matrix between the second frequency and the third frequency.

In the configuration, each of the first antenna element and the second antenna element is provided with a blanched shape. Further, the first antenna element and the second antenna element are positioned in proximity to each other. Moreover, the low coupling circuit that increases susceptance with an increase in frequency is interposed between the antenna elements or between power feeding points. Therefore, a low coupling frequency can be expanded to three frequencies with a smaller number of components. The number of frequencies with which an existing one resonant antenna element not having a bifurcation complies by means of one lumped parameter is limited to two. However, the present invention makes it possible for the antenna element to comply with three frequencies.

Moreover, in the above configuration, a circuit constant is not switched by means of a switch, or the like. Hence, the antenna can be used simultaneously at all frequencies.

In the configuration, a current peak of the first power feeding part and a current peak of the second power feeding part are dispersed to the low coupling circuit, so that a peak SAR (Specific Absorption Rate) can be lessened.

In the configuration, the low coupling circuit is placed at the center of the antenna system, so that the low coupling circuit can be made less susceptible to ambient repercussions.

In the configuration, a real part of the Y12 component of the admittance matrix falls within a range from −30 mS to +30 mS at the first frequency, the second frequency, and the third frequency; and an imaginary part of the Y12 component of the admittance matrix increases in sequence of the first frequency, the second frequency, and the third frequency.

The configuration makes it possible to effect low coupling at three frequencies.

In the configuration, the low coupling circuit has a susceptance value that becomes equal to a value of the imaginary part of the Y12 component of the admittance matrix at the first frequency, the second frequency, and the third frequency; and the low coupling circuit has a function of lessening electromagnetic coupling between the first power feeding part and the second power feeding part.

The configuration makes it possible to effect low coupling at three frequencies.

In the configuration, there is employed at least one of techniques of providing the first antenna element and the second antenna element with a dielectric substance or a magnetic substance, inserting an inductor to an end or an interior of each of the antenna elements, and providing the first antenna element and the second antenna element with a meandering shape.

The configuration enables miniaturization of the first antenna element and the second antenna element.

In the configuration, the low coupling circuit is realized by any one of circuit configurations; a single inductor, a single capacitor, a parallel circuit including an inductor and a capacitor, a combination of a serial inductor with a parallel circuit including an inductor and a capacitor, a combination of a parallel circuit including an inductor and a capacitor with a serial capacitor, and a combination of two series-connected parallel circuits, each of which includes an inductor and a capacitor.

The configuration makes it possible to increase susceptance with respect to a frequency. Further, the low coupling circuit can be configured of at least one component. Hence, a cost increase due to provision of the low coupling circuit can be minimized.

A portable radio of the present invention is equipped with the antenna.

The configuration enables materialization of a portable radio capable of complying with three frequencies.

Advantage of the Present Invention

The present invention makes it possible to suppress deterioration of antenna efficiency due to impediments as well as to comply with three frequencies without involvement of an increase in circuit scale.

EMBODIMENT FOR IMPLEMENTING THE PRESENT INVENTION

A preferred embodiment for practicing the present invention is hereunder described in detail by reference to the drawings.

Figure 1:
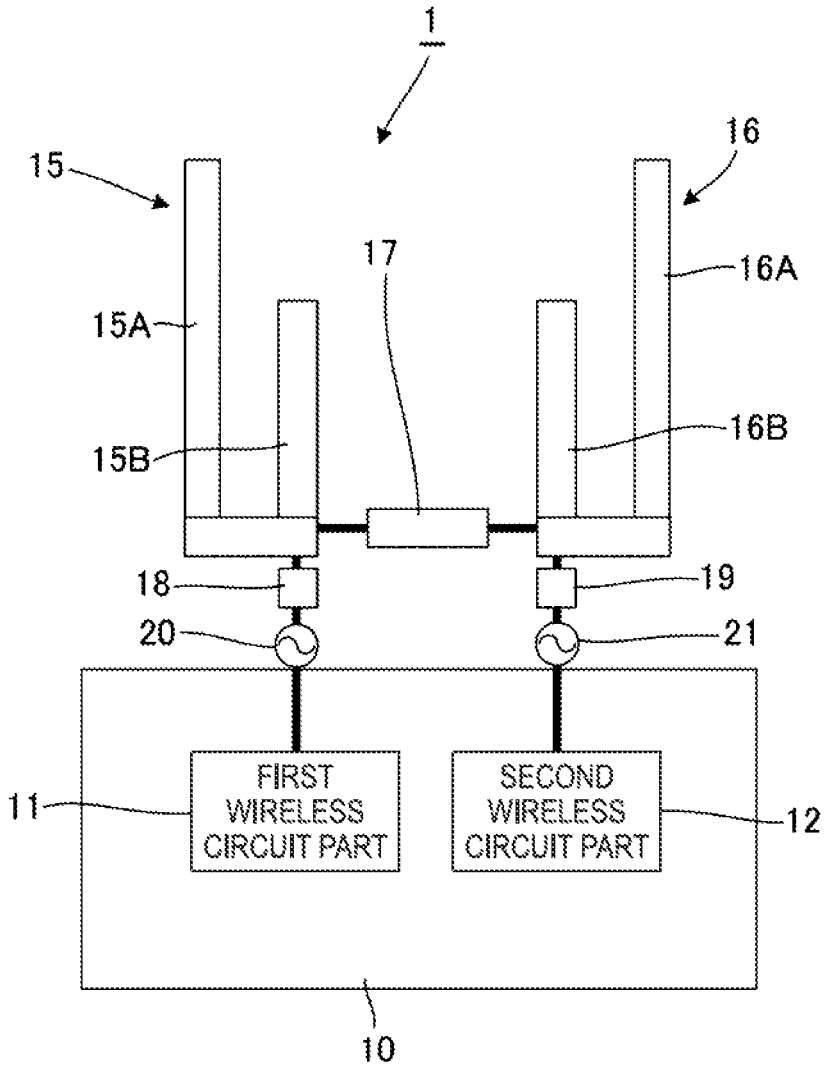
FIG. 1 is a schematic part diagram showing an antenna of an embodiment of the present invention.

FIG. 1 is a schematic part diagram showing an antenna of an embodiment of the present invention. In the drawing, an antenna 1 of the embodiment has a ground pattern (omitted from the drawings) and also includes a circuit board 10 equipped with first and second wireless circuit parts 11 and 12, a first antenna element 15 having a branch structure, a second antenna element 16 having a branch structure, a low coupling circuit 17 interposed between the first antenna element 15 and the second antenna element 16, first and second matching parts 18 and 19, and first and second power feeding parts 20 and 21.

The first antenna element 15 is made of conductive metal and has a first branch element 15A and a second branch element 15B having a shorter electrical length than that of the first branch element 15A. The second antenna element 16 is made of conductive metal and has a third branch element 16A and a fourth branch element 16B having a shorter than that of the third branch element 16A. The first antenna element 15 and the second antenna element 16 are placed in proximity to each other while separated away from the ground pattern (omitted from the drawings) of the circuit board 10 at a predetermined interval, being electrically connected to the first power feeding part 20 placed on the circuit board 10 by way of the first matching part 18 and to the second power feeding part 21 on the circuit board by way of the second matching part 19. The low coupling circuit 17 is compatible with multiple desired frequencies and electrically connects a base end portion (a portion) of the first antenna element 15 to a base end portion (a portion) of the second antenna element 16.

When the multiple desired frequencies are taken as a first frequency, a second frequency, and a third frequency in an ascending order from a low frequency to a higher frequency, the first antenna element 15 and the second antenna element 16 exhibit resonance of a Y12 component of an admittance matrix between the first frequency and the second frequency and between the second frequency and the third frequency. The first branch element 15A and the third branch element 16A are set to a value of nearly a quarter of a resonance electrical length of the Y12 component of the admittance matrix between the first frequency and the second frequency. The second branch element 15B and the fourth branch element 16B are set to a value of nearly a quarter of a resonance electrical length of the Y12 component of the admittance matrix between the second frequency and the third frequency.

The low coupling circuit 17 is a circuit for increasing susceptance with respect to an increase in frequency. The low coupling circuit 17 is materialized by any one of circuit configurations; for instance, a single inductor, a single capacitor, a parallel circuit including an inductor and a capacitor, a combination of a serial inductor with a parallel circuit including an inductor and a capacitor, a combination of a parallel circuit including an inductor and a capacitor with a serial capacitor, and a combination of two series-connected parallel circuits, each of which includes an inductor and a capacitor.

Figure 2:
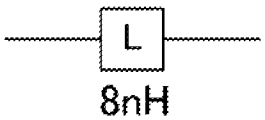
FIG. 2 is a graph chart curve showing a susceptance versus frequency characteristic of a low coupling circuit that is used in the antenna shown in FIG. 1 and embodied in a single inductor.
Figure 2:
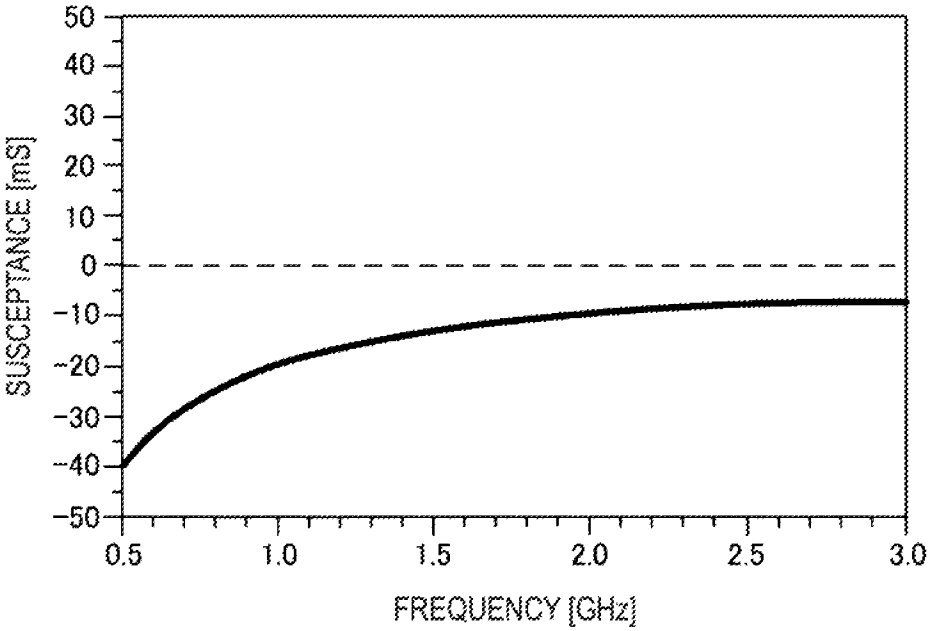
Figure 3:
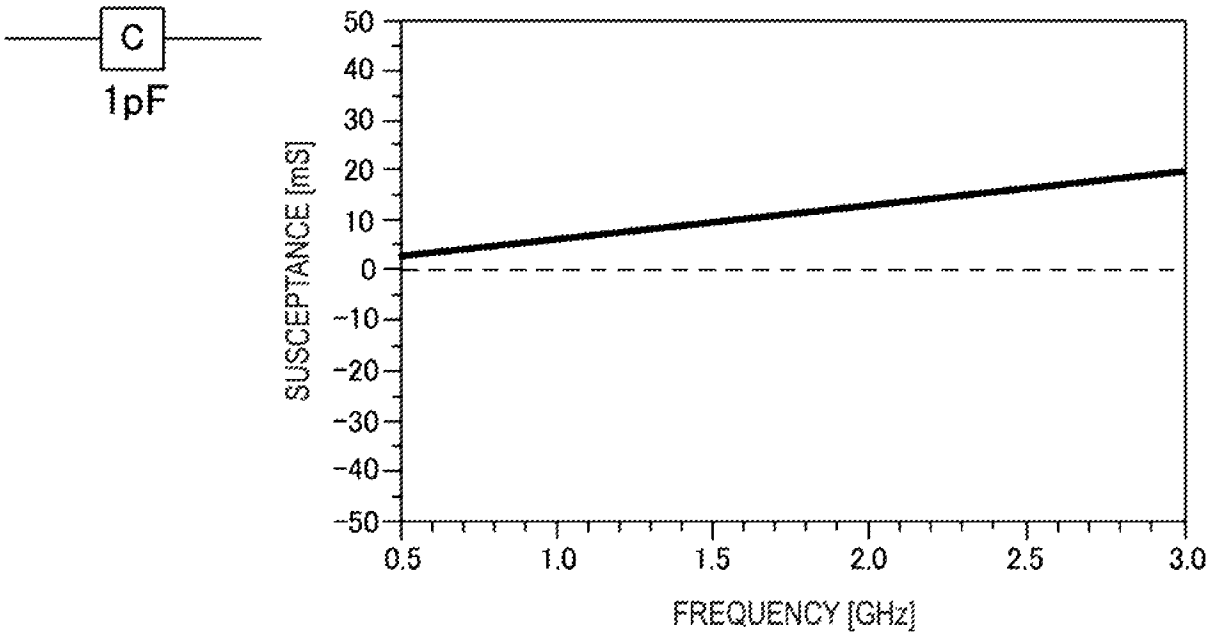
FIG. 3 is a graph chart curve showing a susceptance versus frequency characteristic of the low coupling circuit that is used in the antenna shown in FIG. 1 and embodied in a single capacitor.
Figure 4:
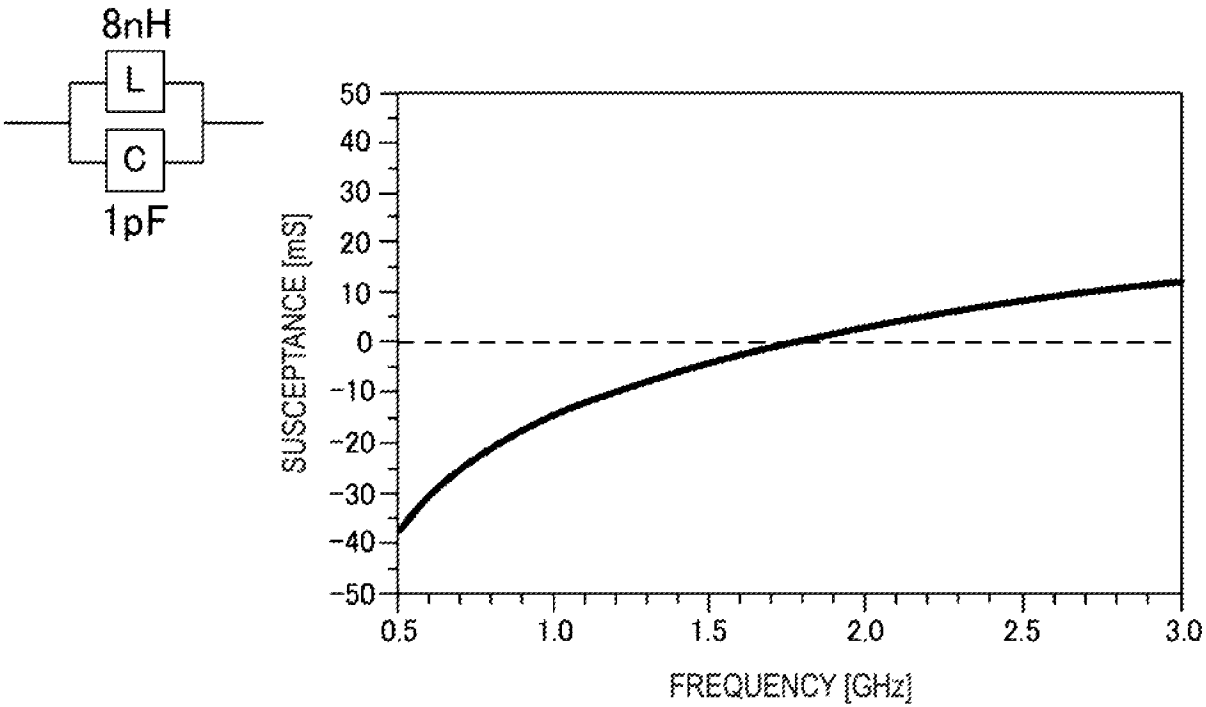
FIG. 4 is a graph chart curve showing a susceptance versus frequency characteristic of the low coupling circuit that is used in the antenna shown in FIG. 1 and embodied in a parallel circuit including an inductor and a capacitor.
Figure 5:
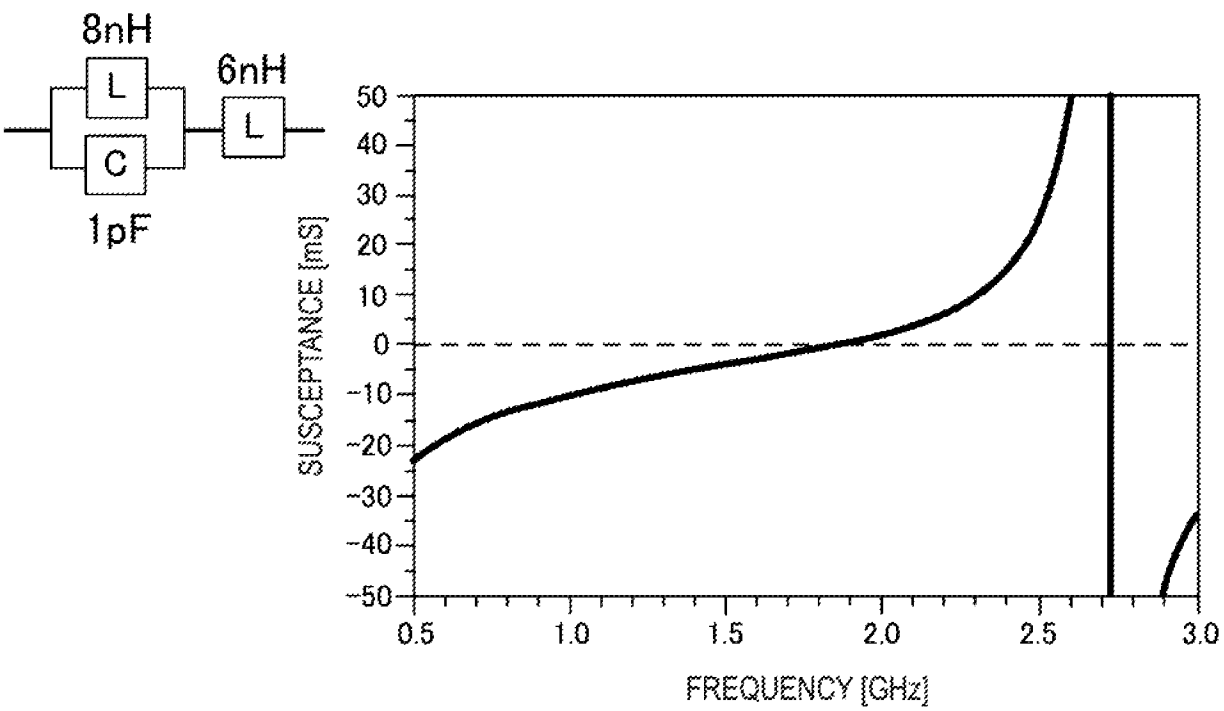
FIG. 5 is a graph chart curve showing a susceptance versus frequency characteristic of the low coupling circuit that is used in the antenna shown in FIG. 1 and embodied in combination of a parallel circuit including an inductor and a capacitor with a serial inductor.
Figure 6:
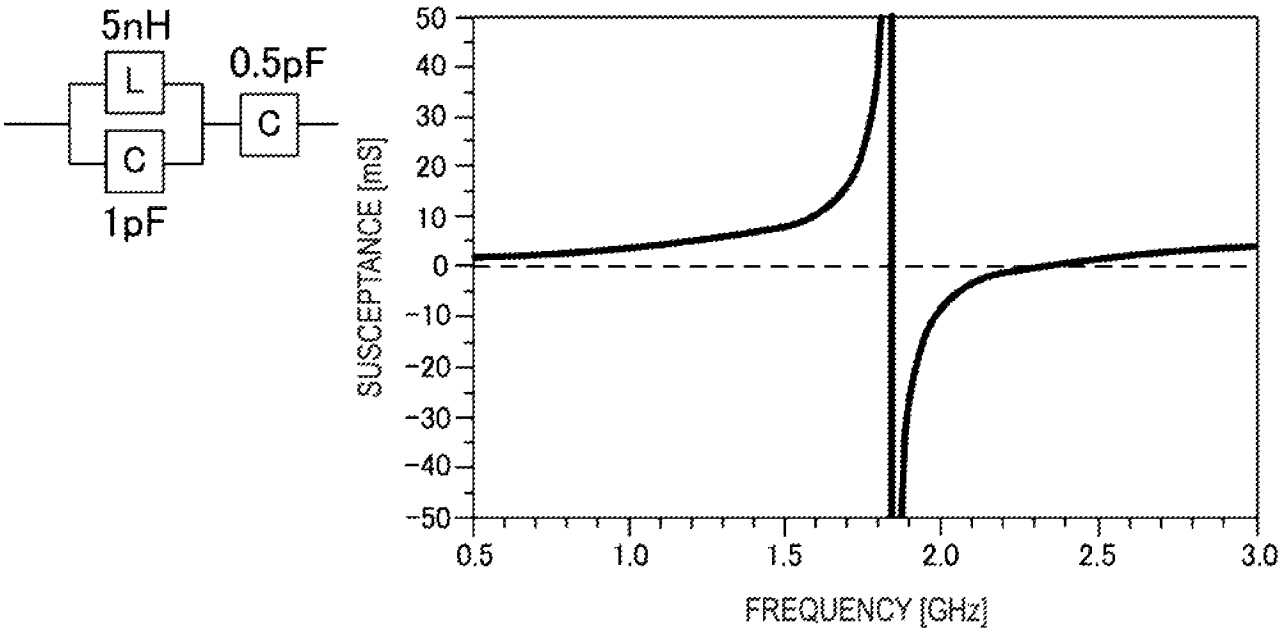
FIG. 6 is a graph chart curve showing a susceptance versus frequency characteristic of the low coupling circuit that is used in the antenna shown in FIG. 1 and embodied in combination of a parallel circuit including an inductor and a capacitor with a serial capacitor.
Figure 7:
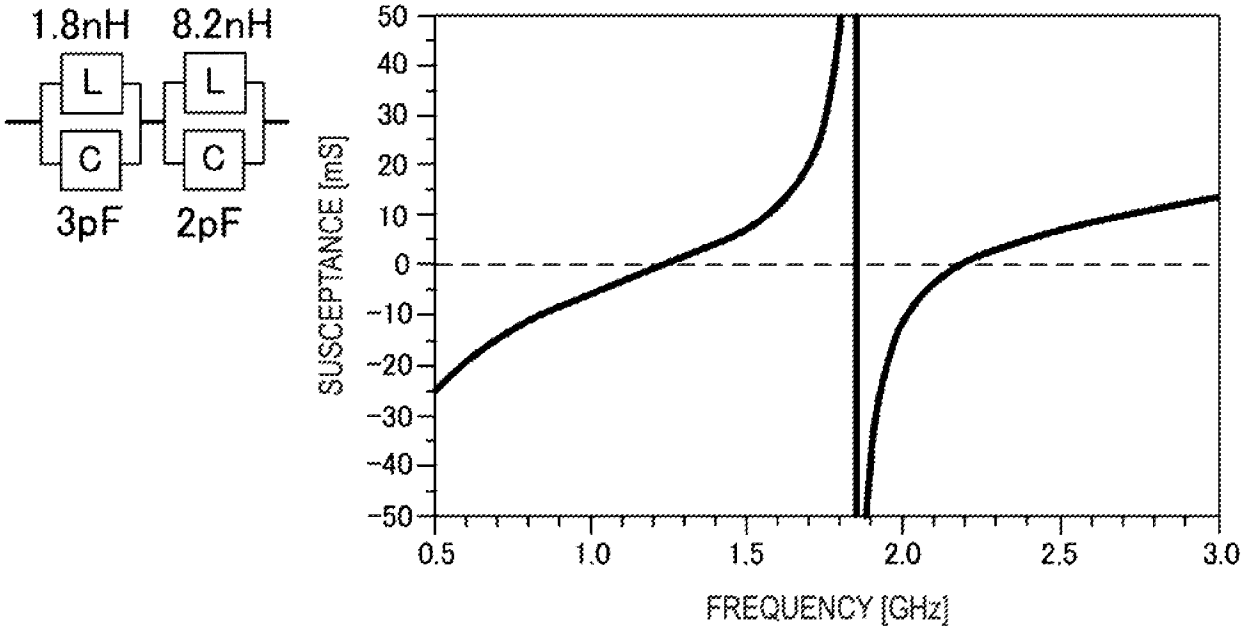
FIG. 7 is a graph chart curve showing a susceptance versus frequency characteristic of the low coupling circuit that is used in the antenna shown in FIG. 1 and embodied in combination of two series-connected parallel circuits, each of which includes an inductor and a capacitor.

FIGS. 2 to 7 are graph chart curves showing a susceptance versus frequency characteristic of the low coupling circuit 17 in each of the circuit configurations. Specifically, FIG. 2 shows a susceptance versus frequency characteristic achieved when the low coupling circuit is embodied in a single inductor. FIG. 3 shows a susceptance versus frequency characteristic achieved when the low coupling circuit is embodied in a single capacitor. FIG. 4 shows a susceptance versus frequency characteristic achieved when the low coupling circuit is embodied in a parallel circuit including an inductor and a capacitor. FIG. 5 shows a susceptance versus frequency characteristic achieved when the low coupling circuit is embodied in a combination of a parallel circuit including an inductor and a capacitor with a serial inductor. FIG. 6 shows a susceptance versus frequency characteristic achieved when the low coupling circuit is embodied in a combination of a parallel circuit including an inductor and a capacitor with a serial capacitor. FIG. 7 shows a susceptance versus frequency characteristic achieved when the low coupling circuit is embodied in a combination of two series-connected parallel circuits, each of which includes an inductor and a capacitor. Since the low coupling circuit 17 can be built from at a minimum of one component (a single inductor or a single capacitor), a cost increase resultant from addition of the low coupling circuit can be minimized. The low coupling circuit 17 can also be disposed so as to electrically connect the first matching part 18 to the second matching part 19 or the first power feeding part 20 to the second power feeding part 21.

Figure 8:
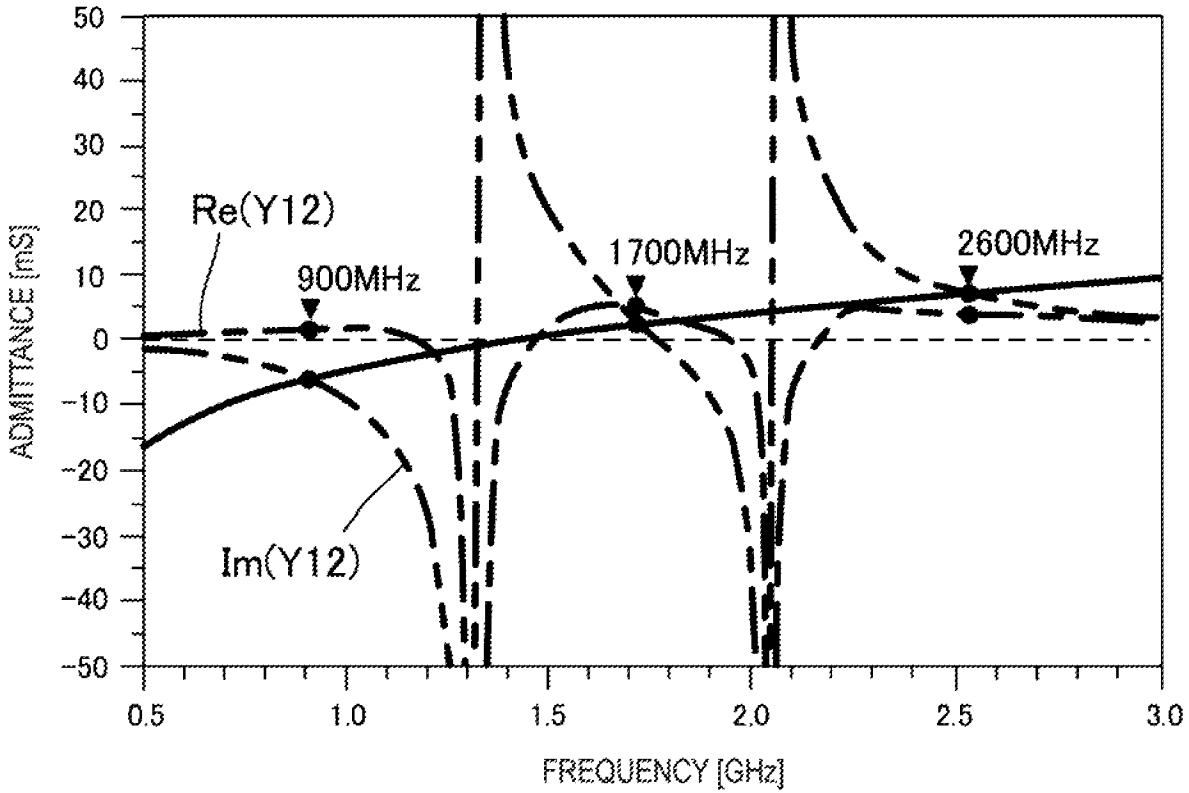
FIG. 8 is a graph chart curve showing an admittance versus frequency characteristic of a single antenna element and a susceptance versus frequency characteristic of a low coupling circuit that are acquired when the low coupling circuit shown in FIG. 4 is used in the antenna shown in FIG. 1.

FIG. 8 is a graph chart curve showing an admittance versus frequency characteristic of a single antenna element acquired when the low coupling circuit 17 having a circuit configuration shown in FIG. 4 is used and a susceptance versus frequency characteristic of the low coupling circuit 17. In the drawing, a frequency characteristic of a real part (Re(Y12)) of the Y 12 component of the admittance matrix of the single antenna element is designated by a dashed line, and a frequency characteristic of an imaginary part (Im(Y12)) of the Y 12 component of the admittance matrix of the single antenna element is designated by a chain double-dashed line. A susceptance versus frequency characteristic of the low coupling circuit 17 is designated by a solid line. In this case, the characteristic becomes identical with that shown in FIG. 4. Under the conditions of a value at which there are attained the real part Re (Y12) of the Y12 component of the admittance matrix≈0 and the imaginary part Im (Y12) of the Y12 component of the admittance matrix=a susceptance value of the low coupling circuit 17 being satisfied, low coupling can be effected at a desired frequency. In the example shown in FIG. 8, the conditions are satisfied at 900 MHz, 1700 MHz, and 2600 MHz.

Figure 9:
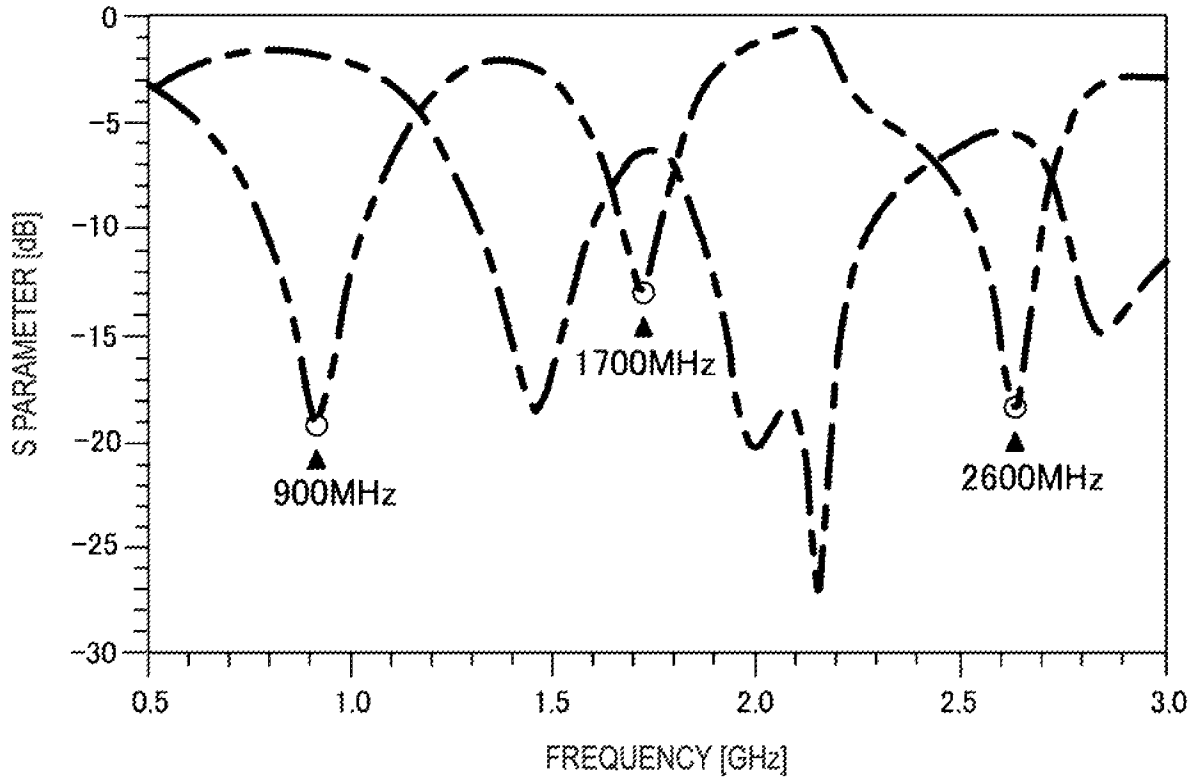
FIG. 9 is a graph chart curve showing a frequency characteristic that depicts the admittance of FIG. 8 by means of an S parameter.

FIG. 9 is a graph chart curve showing a frequency characteristic that depicts the admittance of FIG. 8 by means of an S parameter. In the drawing, a frequency characteristic of an S parameter (S11) representing matching is designated by a dashed line, and a frequency characteristic of an S parameter (S12) representing coupling is designated by a chain double-dashed line. It is understood that low coupling is achieved at three frequencies of 900 MHz, 1700 MHz, and 2600 MHz.

In order to generate two resonances or more of Y12 of the admittance matrix, the resonances cannot be realized by means of the single antenna element. However, it becomes possible to generate two resonances or more of Y12 by applying a branch structure to the antenna element. For this reason, the antenna 1 of the embodiment adopts a branch structure for the first antenna element 15 and the second antenna element 16. In the antenna 1 of the embodiment, the followings are adopted in order to effect low coupling at three frequencies.

(1) When desired frequencies at which low coupling is to be effected are taken as a first frequency, a second frequency, and a third frequency in an ascending order from a low frequency to a higher frequency, a single antenna element exhibits a first resonance of Y12 between the first frequency and the second frequency and a second resonance of Y12 between the second frequency and the third frequency.

(2) In order to exhibit two resonances of (1), each of the first antenna element 15 and the second antenna element 16 is equipped with two branch elements. In order to exhibit a low frequency resonance, the first branch element 15A and the second branch element 16A are set to nearly a quarter wavelength of the resonant electrical length. In order to exhibit a high frequency resonance, the second branch element 15B and the fourth branch element 16B are set to nearly a quarter wavelength of the resonant electrical length.

(3) The real part Re(Y12) of the Y12 component of the admittance matrix of the single antenna element assumes a value of $-30\ \text{mS} < \text{Re}(Y12) < +30\ \text{mS}$ at the first through third frequencies.

(4) The imaginary part Im(Y12) of the Y12 component of the admittance matrix increases in an ascending order from a low frequency to a higher frequency; namely, the first frequency to the third frequency.

(5) The low coupling circuit 17 using an inductor, a capacitor, and a combination thereof is interposed between the first antenna element 15 and the second antenna element 16, thereby generating a susceptance value of the low coupling circuit that becomes equal to a value of the imaginary part Im(Y12) of the Y 12 component of the admittance matrix of the single antenna element at the first through third frequencies.

Figure 10:
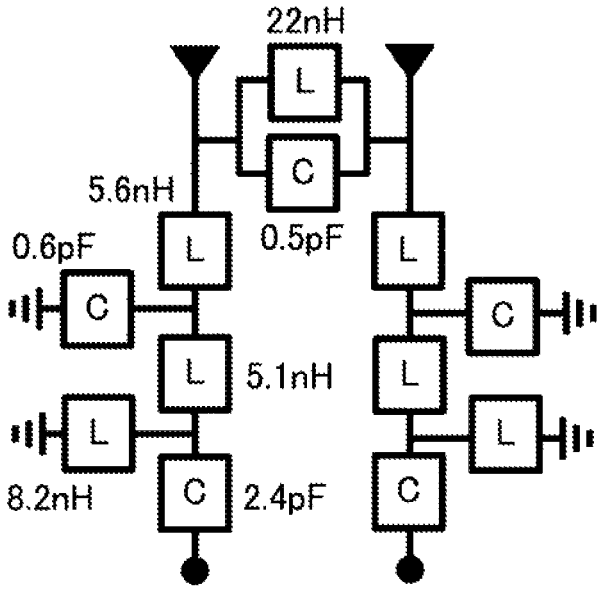
FIG. 10 is a diagram showing a specific, example equivalent circuit of first and second antenna elements and a specific, example low coupling circuit embodied in a parallel circuit including an inductor and a capacitor of the antenna shown in FIG. 1.

FIG. 10 is a diagram showing a specific, example equivalent circuit of the first antenna element 15 and the second antenna element 16 and a specific, example low coupling circuit 17 embodied in a parallel circuit including an inductor and a capacitor. As illustrated, in each of the first antenna element 15 and the second antenna element 16, two inductors (5.6 nH and 5.1 nH) and one capacitor (2.4 pF) are connected in series. Further, a capacitor (0.6 pF) is connected to a junction between a common node of the two series-connected inductors and a ground. In addition, an inductor (8.2 nH) is connected to a junction between the ground and a common node of the inductor series-connected to the capacitor. In the low coupling circuit 17 including an inductor and a capacitor that are connected in parallel to each other, the inductor is 22 nH, and the capacitor is 0.5 pF.

Figure 11:
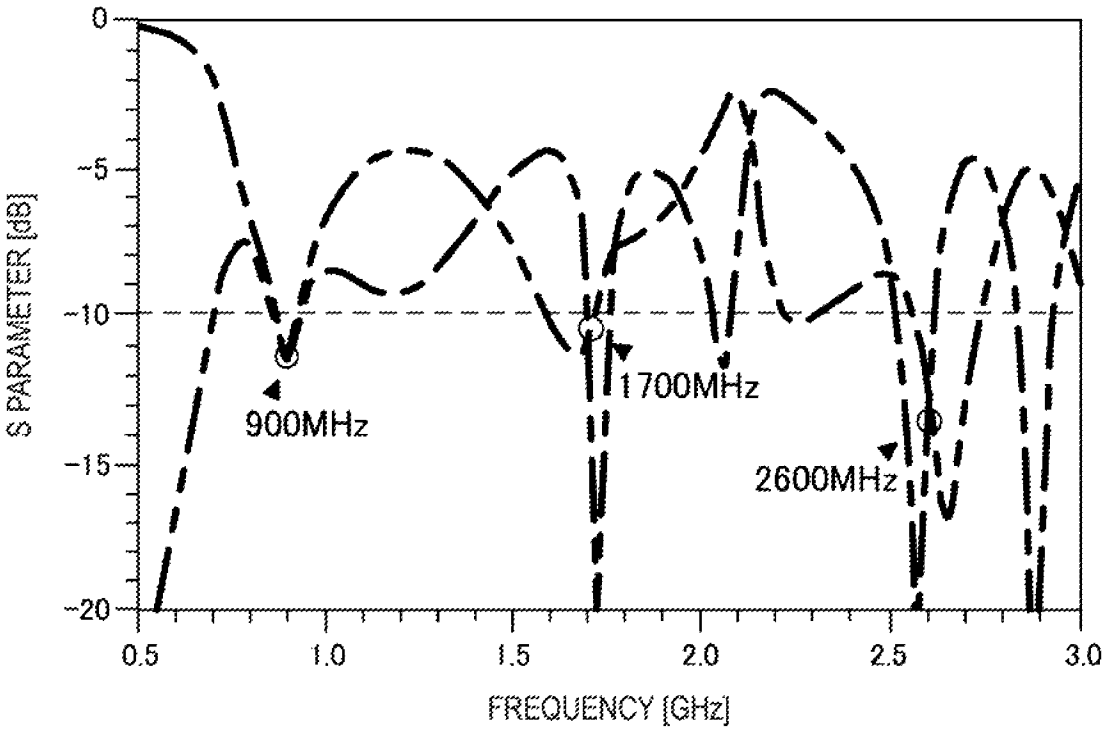
FIG. 11 is a graph chart curve showing a frequency characteristic of an S parameter acquired in the specific example shown in FIG. 10.

FIG. 11 a graph chart curve showing a frequency characteristic of an S parameter acquired in the specific example shown in FIG. 10. In the drawing, a frequency characteristic of an S parameter (S11) representing matching is designated by a dashed line, and a frequency characteristic of an S parameter (S12) representing coupling is designated by a chain double-dashed line. By means of use of the low coupling circuit 17, the first matching part 18, and the second matching part 19, the S parameter S11 and the S parameter S12 can be set to a value of −10 dB or less at the three frequencies of 900 MHz, 1700 MHz, and 2600 MHz.

Figure 12:
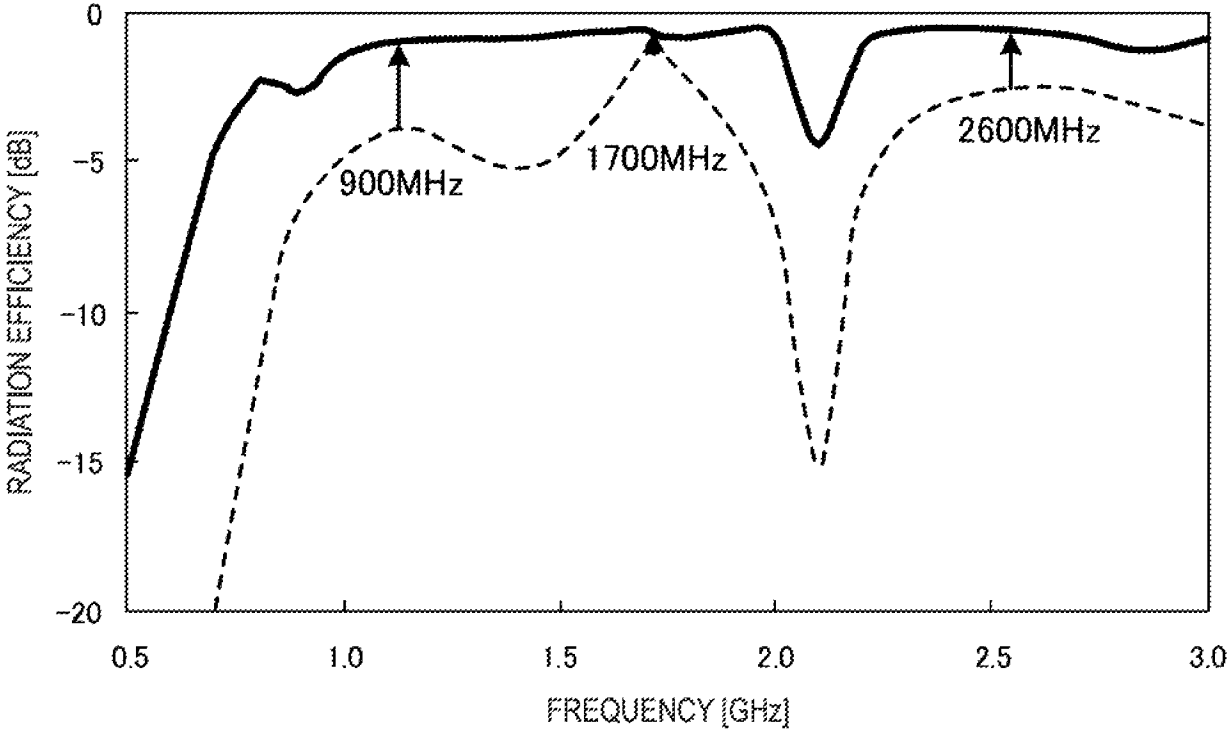
FIG. 12 is a graph chart curve showing a frequency characteristic of antenna efficiency acquired in the specific example shown in FIG. 10.

FIG. 12 is a graph chart curve showing a frequency characteristic of antenna efficiency acquired in the specific example shown in FIG. 10. In the drawing, antenna efficiency achieved at the time of use of the low coupling circuit 17, the first matching part 18, and the second matching part 19 is designated by a solid line. Antenna efficiency achieved at the time of use of only the first matching part 18 and the second matching part 19 is designated by a dotted line. It is understood that, when compared with antenna efficiency achieved in a case where only the first matching part 18 and the second matching part 19 are used without use of the low coupling circuit 17, the antenna efficiency is enhanced at the three frequencies of 900 MHz, 1700 MHz, and 2600 MHz. Specifically, the antenna efficiency is enhanced by 3.9 dB at 900 MHz; it is enhanced by 0.7 dB at 1700 MHz; and it is also enhanced by 1.8 dB at 2600 MHz.

Figure 13:
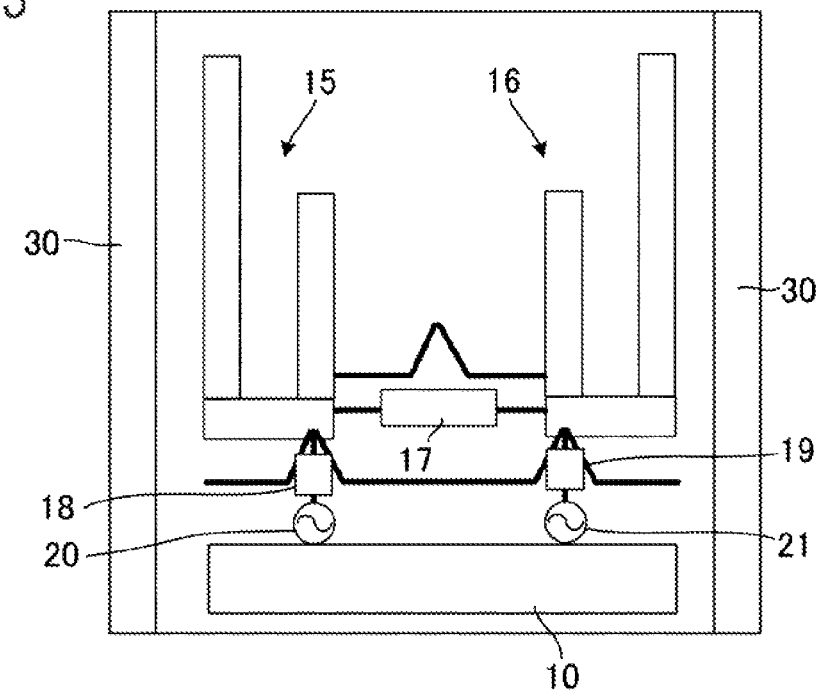
FIGS. 13 (*a*) and (*b*) are diagrams showing current distributions of the antenna shown in FIG. 1.
Figure 13:
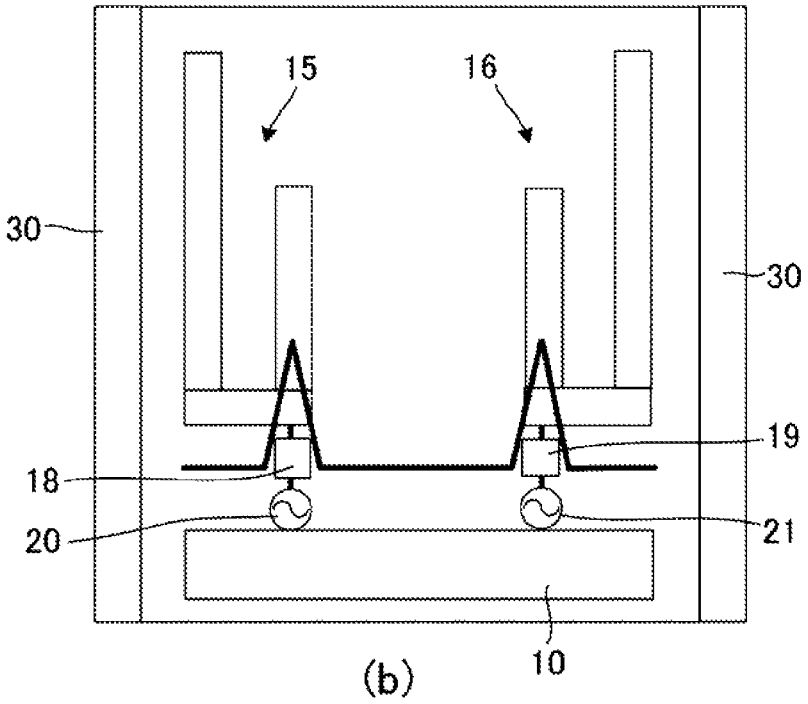

FIGS. 13(*a*) and 13(*b*) are diagrams showing current distributions of the antenna 1 shown in FIG. 1. FIG. 13(*a*) shows a current distribution appearing when the antenna has the low coupling circuit 17, and FIG. 13(*b*) shows a current distribution appearing when the antenna is devoid of the low coupling circuit 17. When the antenna has the low coupling circuit 17, an electric current flows to the low coupling circuit 17, too. The antenna, however, is devoid of the low coupling circuit 17, the electric current concentrates on the first power feeding part 20 and the second power feeding part 21. In contrast, when the antenna has the low coupling circuit 17, the electric current flows to the low coupling circuit 17, too. Specifically, the electric current concentrated on the first power feeding part 20 and the second power feeding part 21 is distributed into the first power feeding part 20, the second power feeding part 21, and the low coupling circuit 17, and hence the electric current flows also to the low coupling circuit 17. As a result of the electric current flowing also to the low coupling circuit 17, an SAR peak value decreases, so that deterioration of antenna efficiency, which would otherwise arise when a mobile terminal (omitted from the drawing) using the antenna 1 is held by hand, can be suppressed. Moreover, as shown in FIG. 13(*a*), even when an impediment 30 has approached a circumstance of the first antenna element 15 and the second antenna element 16, a current peak appears also in the center low coupling circuit 17. Hence, deviation of matching and deterioration of antenna efficiency become smaller compared with a case where the low coupling measures are not taken.

Figure 14:
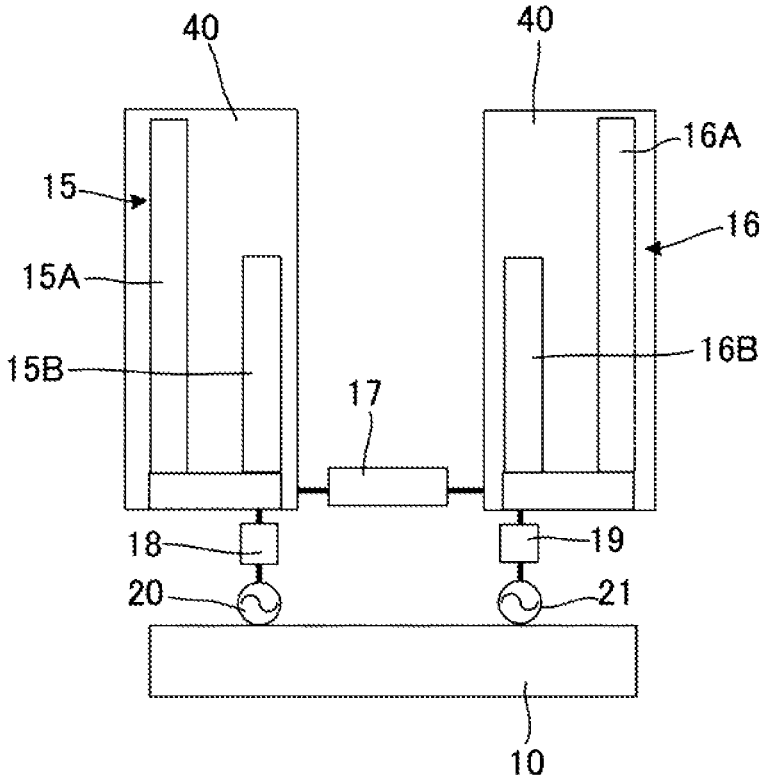
FIG. 14 is a diagram showing an example layout of a dielectric substance (or a magnetic substance) placed in the first and second antenna elements of the antenna shown in FIG. 1.
Figure 15:
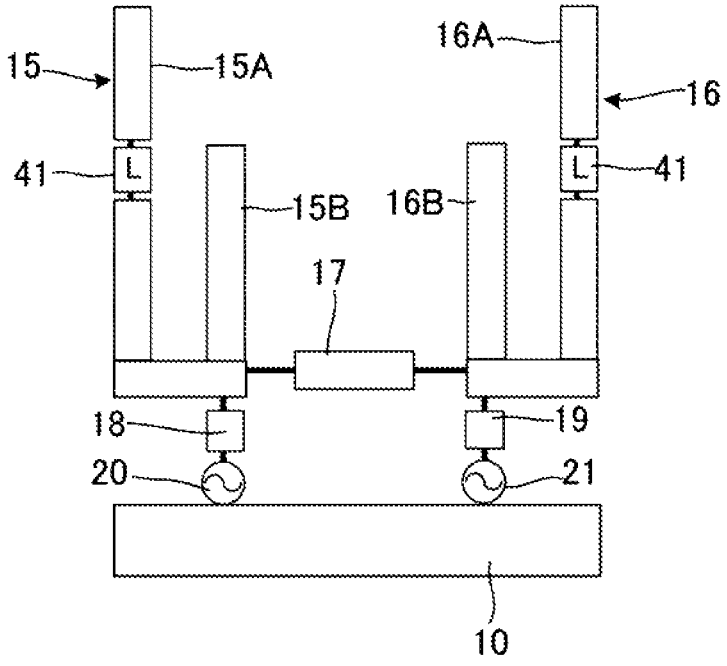
FIG. 15 is a diagram showing an example in which an inductor is disposed in each of first and third branch elements in each of the first and second antenna elements of the antenna shown in FIG. 1.
Figure 16:
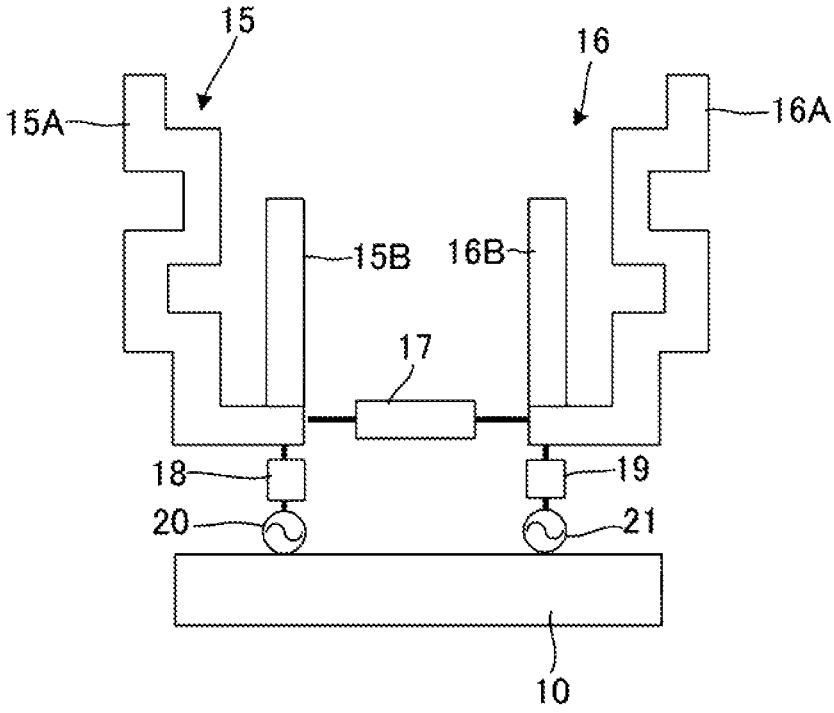
FIG. 16 is a diagram showing an example in which the first and third branch elements in each of the first and second antenna elements of the antenna shown in FIG. 1 are given a meandering shape.

FIGS. 14 through 16 are diagrams showing a technique for miniaturizing the antenna element of the antenna 1 of the embodiment. FIG. 14 is a diagram showing an example layout of a dielectric substance (or a magnetic substance) 40 placed in the first antenna element 15 and the second antenna element 16. A physical length of the first antenna element 15 and that of the second antenna element 16 can be reduced by placement of the dielectric substance (or the magnetic substance) 40. However, an electrical length of the antenna elements still remains unchanged; namely, nearly a lambda quarter. FIG. 15 is a diagram showing an example in which an inductor 41 is disposed in each of the first branch element 15A and the third branch element 16A in each of the first antenna element 15 and the second antenna element 16. FIG. 16 is a diagram showing an example in which the first branch element 15A and the third branch element 16A in each of the first antenna element 15 and the second antenna element 16 are given a meandering shape. As a matter of course, the techniques shown in FIGS. 14 through 16 can be adopted in combination.

As mentioned above, in the antenna 1 of the embodiment, each of the first antenna element 15 and the second antenna element 16 is provided with a branch structure. Further, the first antenna element 15 and the second antenna element 16 are placed in proximity to each other, and the low coupling circuit 17 configured such that susceptance increases with an increase in frequency is interposed between the antenna elements 15 and 16. Furthermore, the first antenna element 15 and the second antenna element 16 exhibit resonance of the Y12 component of the admittance matrix between the first frequency and the second frequency and between the second frequency and the third frequency. The first branch element 15A and the third branch element 16A are set to a value of nearly a quarter of a resonance electrical length of the Y12 component of the admittance matrix between the first frequency and the second frequency. The second branch element 15B and the fourth branch element 16B are set to a value of nearly a quarter of a resonance electrical length of the Y12 component of the admittance matrix between the second frequency and the third frequency. Accordingly, the antenna can expand the low coupling frequency to three frequencies with a smaller number of components.

The antenna 1 of the embodiment does not involve switching a circuit constant by means of a switch, or the like, and hence can use all frequencies simultaneously. Further, since a current peak of the first power feeding part 20 and a current peak of the second power feeding part 21 can be distributed to the low coupling circuit 17, the peak SAR can be lessened. Moreover, since the low coupling circuit 17 is placed at the center of the antenna system, the low coupling circuit becomes less susceptible to environmental repercussions.

An exemplary modification of the antenna 1 of the embodiment is now described.

First Exemplary Modification

Figure 17:
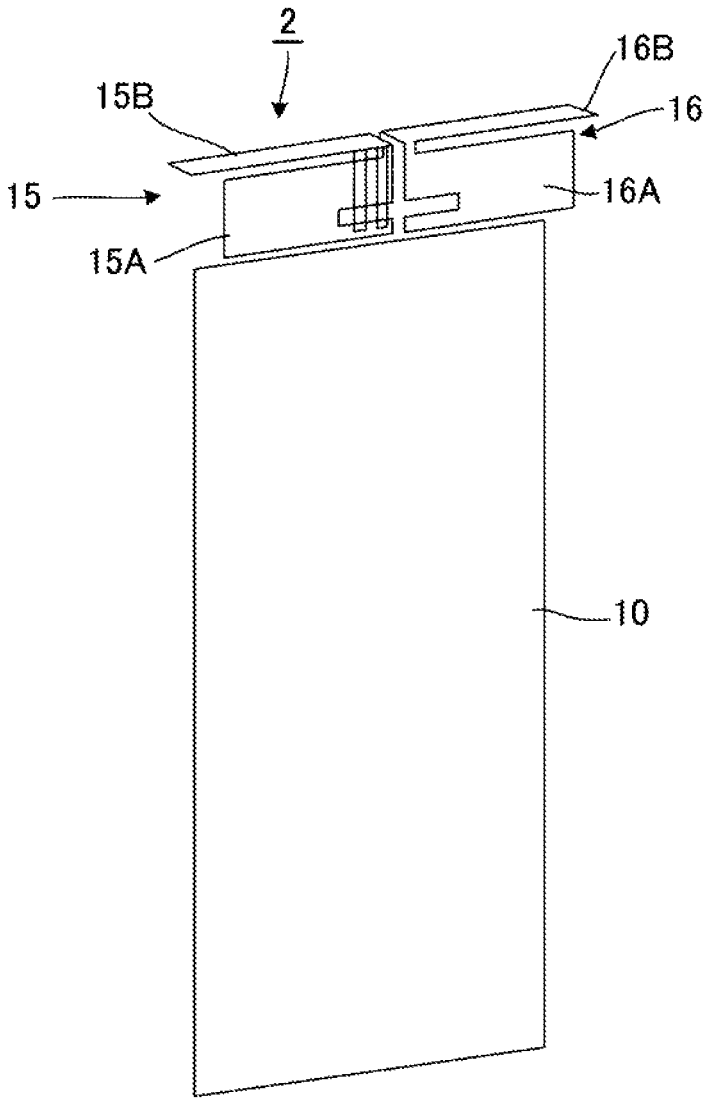
FIG. 17 is a perspective view showing an overview of a first exemplary modification of the antenna shown in FIG. 1.
Figure 18:
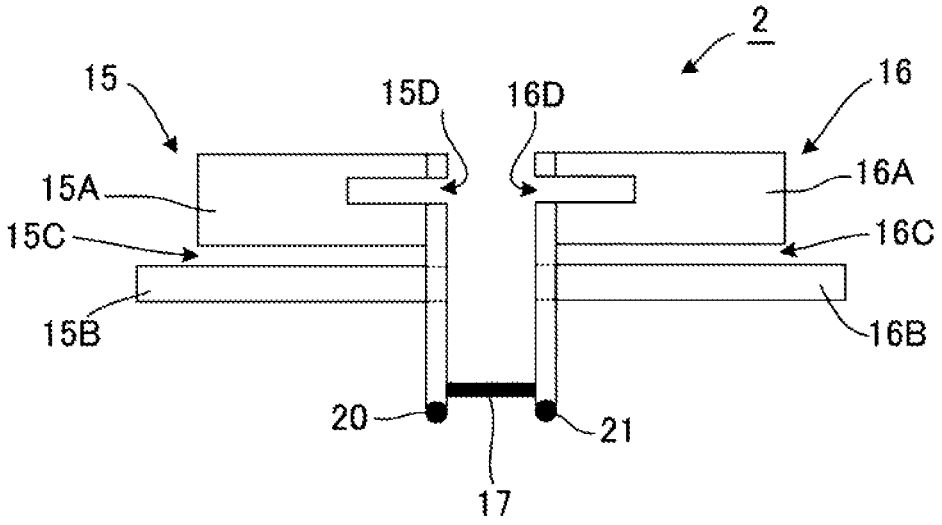
FIG. 18 is a development elevation showing first and second antenna elements of the first exemplary modification shown in FIG. 17.
Figure 19:
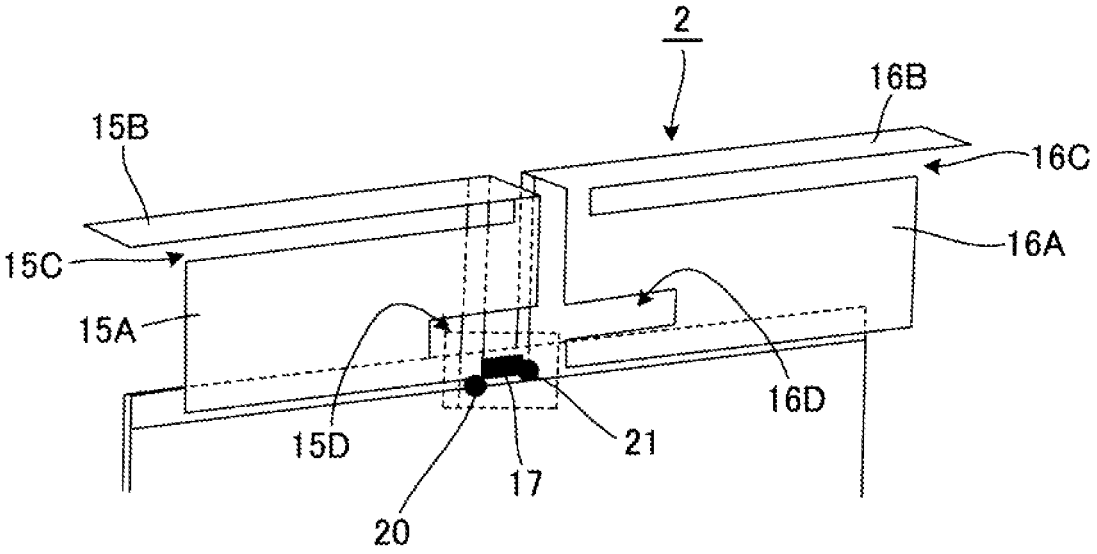
FIG. 19 is a perspective view showing the first and second antenna elements of the first exemplary modification shown in FIG. 17.

FIG. 17 is a perspective view showing an overview of an antenna 2 that is a first exemplary modification of the antenna 1 shown in FIG. 1. FIG. 18 is a development elevation showing a first antenna element and a second antenna element of the antenna 2 that is the first exemplary modification shown in FIG. 17. FIG. 19 is a perspective view showing the first antenna element and the second antenna element of the antenna 2 that is the first exemplary modification shown in FIG. 17. In FIG. 17 through FIG. 19, portions of the antenna that perform operations common to the antenna 1 shown in FIG. 1 are assigned the same reference numerals, though they differ from each other in relation to a shape.

In the antenna 2 of the first exemplary modification, each of the first and second antenna elements 15 and 16 assumes a folded structure having a substantially L-shaped cross sectional profile. A slit 15C is formed in the first antenna element 15 having the folded structure, and a slit 16C is formed in the second antenna element 16 having the folded structure, whereby the antenna elements are made equivalent to a branch element. A slit 15D which is shorter than the slit 15C is additionally formed in the piece of the first antenna element 15 that is made equivalent to a branch element, thereby making an electrical length of the first antenna element 15 longer. Likewise, a slit 16D which is shorter than the slit 16C is formed in the piece of the second antenna element 16 that is made equivalent to a branch element, thereby making an electrical length of the second antenna element 16 longer. Specifically, the slit 15D that is shorter than the slit 15C is formed in an area corresponding to the first branch element 15A, thereby making the electrical length of the first branch element 15A longer. Likewise, the slit 16D that is shorter than the slit 15C is formed in an area corresponding to the third branch element 16A, thereby making the electrical length of the third branch element 16A longer.

Figure 20:
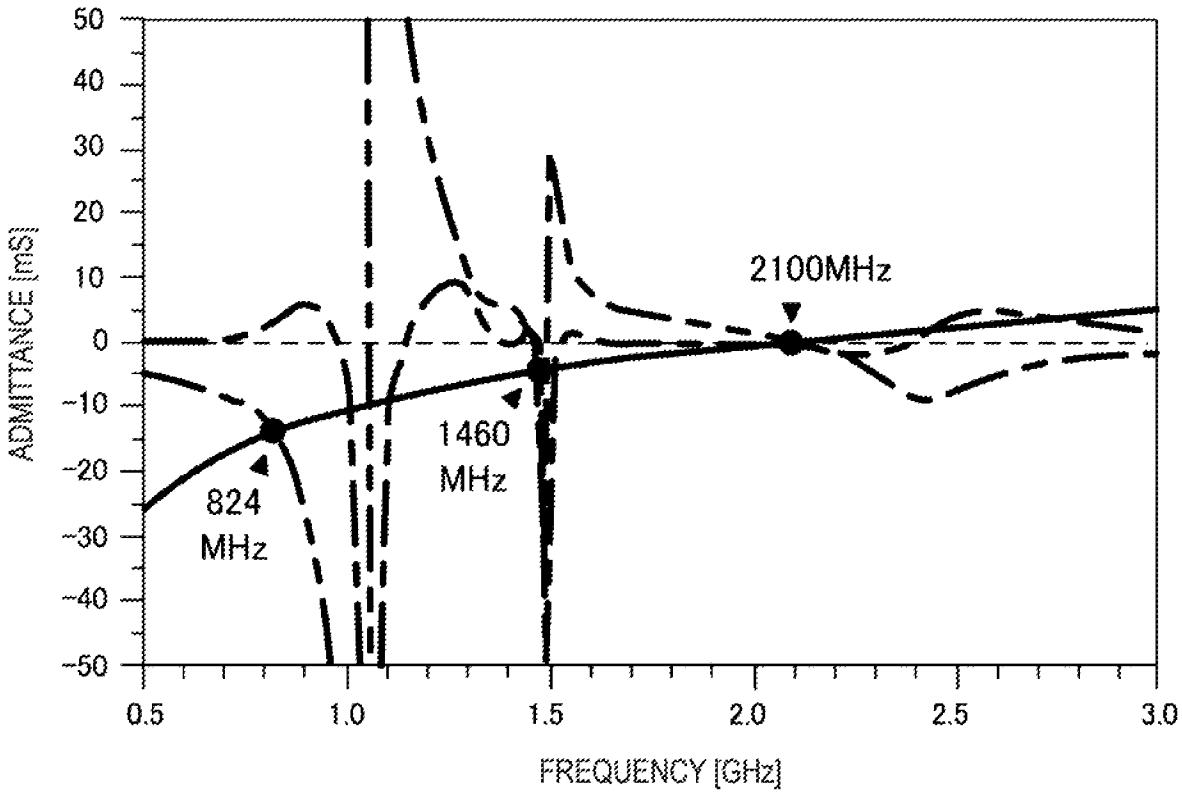
FIG. 20 is a graph chart curve showing an admittance versus frequency characteristic of a single antenna element and a susceptance versus frequency characteristic of a low coupling circuit that are acquired in the first exemplary modification shown in FIG. 17.

FIG. 20 is a graph chart curve showing an admittance versus frequency characteristic of a single antenna element and a susceptance versus frequency characteristic of the low coupling circuit 17 that are acquired in the antenna 2 of the first exemplary modification shown in FIG. 17. In the drawing, a circuit configuration shown in FIG. 4, in which an inductor and a capacitor are connected in parallel, is used for the low coupling circuit 17. As in the case of FIG. 8, the frequency characteristic of the real part (Re(Y12)) of the Y12 component of the admittance matrix of the single antenna element is designated by a dashed line, and the frequency characteristic of the imaginary part (Im(Y12)) of the Y12 component of the admittance matrix of the single antenna element is designated by a chain double-dashed line. A susceptance versus frequency characteristic of the low coupling circuit 17 is designated by a solid line. Under the conditions of a value at which there are attained the real part Re (Y12) of the Y12 component of the admittance matrix≈0 and the imaginary part Im (Y12) of the Y12 component of the admittance matrix=a susceptance value of the low coupling circuit 17 being satisfied, low coupling can be effected at a desired frequency. In the antenna 2 of the first exemplary modification, the conditions are satisfied at 824 MHz, 1460 MHz, and 2100 MHz.

Second Exemplary Modification

Figure 21:
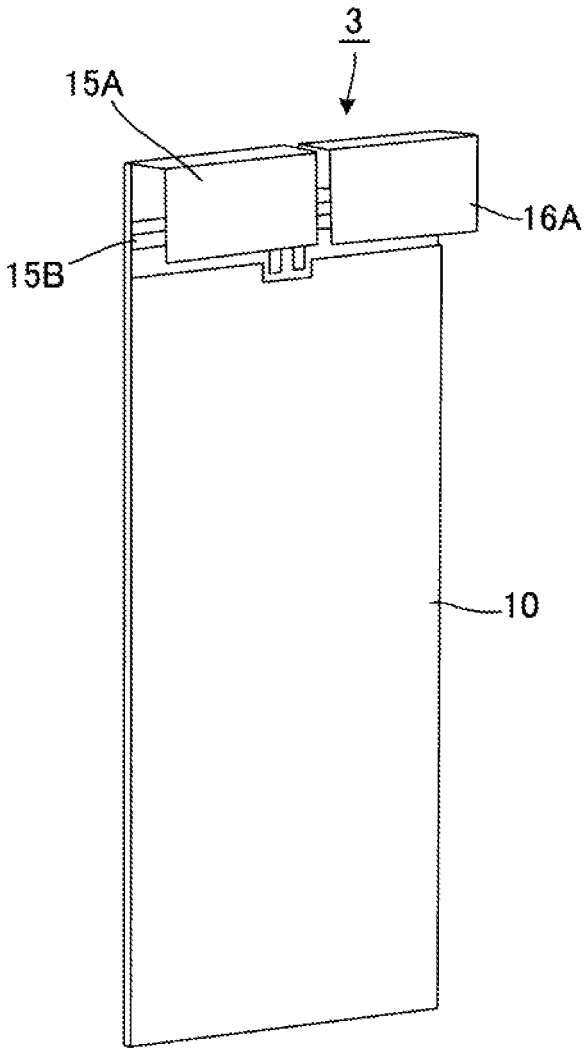
FIG. 21 is a perspective view showing an overview of a second exemplary modification of the antenna shown in FIG. 1.
Figure 22:
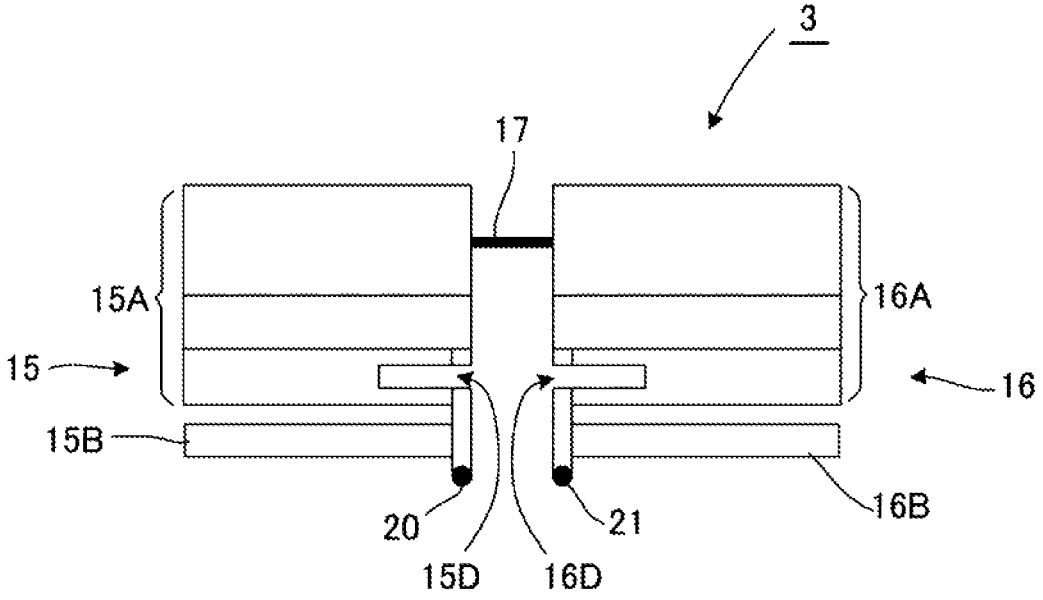
FIG. 22 is a development elevation showing first and second antenna elements of the second exemplary modification shown in FIG. 21.
Figure 23:
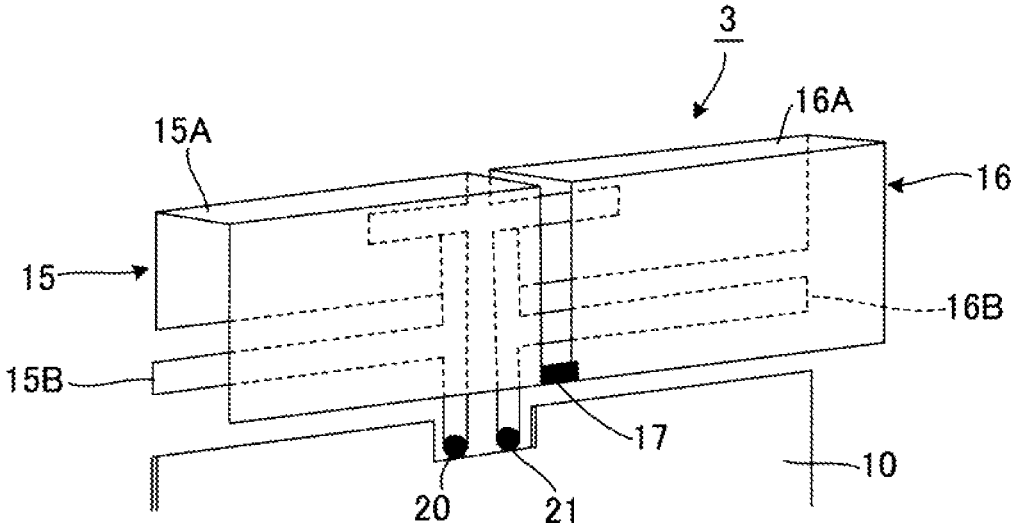
FIG. 23 is a perspective view showing the first and second antenna elements of the second exemplary modification shown in FIG. 21.

FIG. 21 is a perspective view showing an overview of an antenna 3 of a second exemplary modification of the antenna 1 shown in FIG. 1. FIG. 22 is a development elevation showing a first antenna element and a second antenna element of the antenna 3 of the second exemplary modification shown in FIG. 21. FIG. 23 is a perspective view showing the first antenna element and the second antenna element of the antenna 3 of the second exemplary modification shown in FIG. 21. In FIG. 21 through FIG. 23, portions of the antenna that perform operations common to the antenna 1 shown in FIG. 1 are assigned the same reference numerals, though they differ from each other in relation to a shape.

In the antenna 3 of the second exemplary modification, each of the first and second antenna elements 15 and 16 assumes a folded structure having a substantially C-shaped cross sectional profile. Further, a monopole element 15B and a monopole element 16B are added as a second branch element and a fourth branch element to the first antenna element 15 and the second antenna element 16, respectively, thereby making the antenna elements equivalent to the branch elements. The monopole elements 15B and 16B serving as the second and fourth branch elements are formed at positions separated from the first branch element 15A and the third branch element 16A, respectively. A distance of separation employed in this case is approximately identical with the distance from the slits 15C and 16C of the antenna 2 of the first exemplary modification. Slits 15D and 16D that are approximately the same as those made in the antenna 2 of the first exemplary modification are formed in the first branch element 15A and the second branch element 16A, respectively, thereby making an electrical length of each of the first branch element 15A and the second branch element 16A longer.

Figure 24:
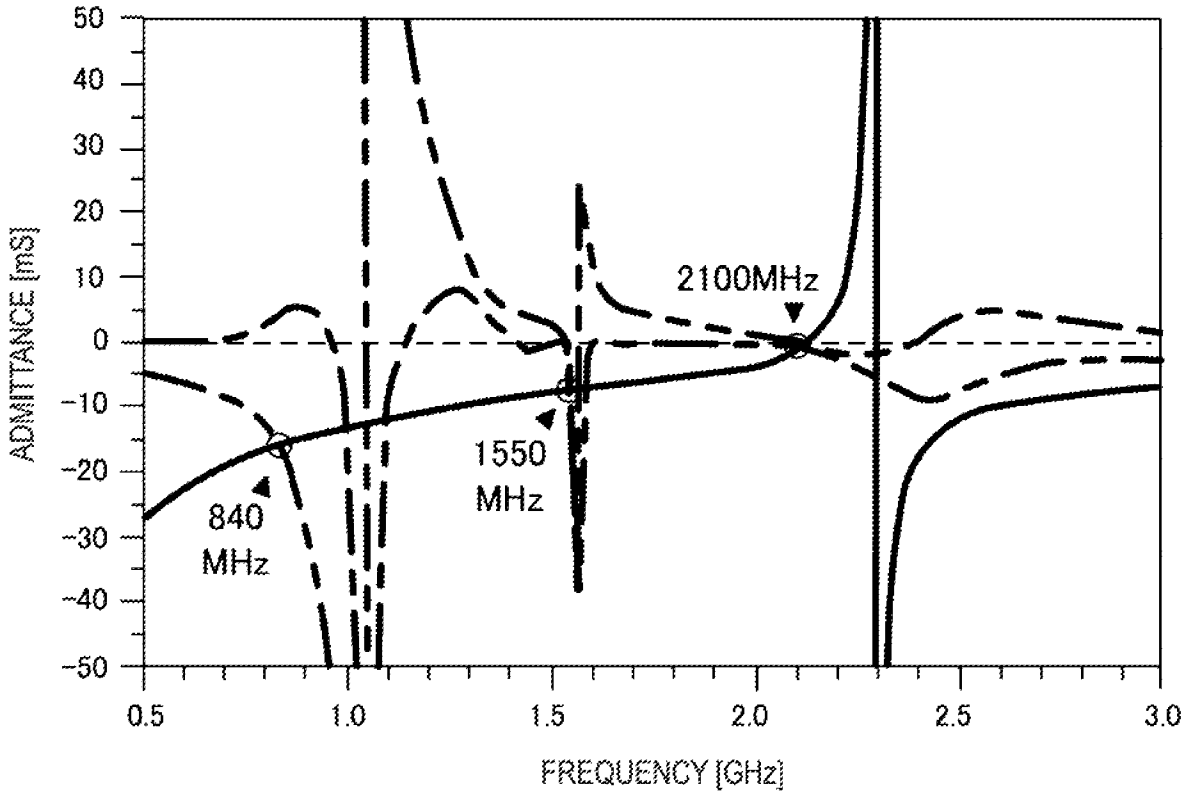
FIG. 24 is a graph chart curve showing an admittance versus frequency characteristic of a single antenna element and a susceptance versus frequency characteristic of the low coupling circuit that are acquired in the second exemplary modification shown in FIG. 21.

FIG. 24 is a graph chart curve showing an admittance versus frequency characteristic of a single antenna element and a susceptance versus frequency characteristic of the low coupling circuit 17 that are acquired in the antenna 3 of the second exemplary modification. In the drawing, a circuit configuration shown in FIG. 5, in which an inductor is series-connected to a parallel circuit including an inductor and a capacitor, is used for the low coupling circuit 17. As in the case of FIG. 8, the frequency characteristic of the real part (Re(Y12)) of the Y12 component of the admittance matrix of the single antenna element is designated by a dashed line, and the frequency characteristic of the imaginary part (Im(Y12)) of the Y12 component of the admittance matrix of the single antenna element is designated by a chain double-dashed line. A susceptance versus frequency characteristic of the low coupling circuit 17 is designated by a solid line. Under the conditions of a value at which there are attained the real part Re (Y12) of the Y12 component of the admittance matrix≈0 and the imaginary part Im (Y12) of the Y12 component of the admittance matrix=a susceptance value of the low coupling circuit 17 being satisfied, low coupling can be effected at a desired frequency. In the antenna 3 of the second exemplary modification, the conditions are satisfied at 840 MHz, 1550 MHz, and 2100 MHz.

Although the present invention has been described in detail by reference to the specific embodiment, it is manifest to those skilled in the art that the present invention be susceptible to various alterations or modifications without departing the spirit and scope of the present invention.

The patent application is based on Japanese Patent Application (JP-2011-112274) filed on May 19, 2011, the subject matter of which is incorporated herein by reference in its entirety.

INDUSTRIAL APPLICABILITY

The present invention yields an advantage of the ability to conform to three frequencies without involvement of an increase in circuit scale and less deterioration of antenna efficiency due to an impediment and can be applied to a mobile terminal.

DESCRIPTIONS OF THE REFERENCE NUMERALS AND SYMBOLS

1, 2 3 ANTENNA
10 CIRCUIT BOARD
11 FIRST WIRELESS CIRCUIT PART
12 SECOND WIRELESS CIRCUIT PART
15 FIRST ANTENNA ELEMENT
15A FIRST BRANCH ELEMENT
15B SECOND BRANCH ELEMENT (MONOPOLE ELEMENT)
15C, 15D SLIT
16 SECOND ANTENNA ELEMENT
16A THIRD ANTENNA ELEMENT
16B FOURTH ANTENNA ELEMENT (MONOPOLE ELEMENT)
16C, 16D SLIT
17 LOW COUPLING CIRCUIT
18 FIRST MATCHING PART
19 SECOND MATCHING PART
20 FIRST POWER FEEDING PART
21 SECOND POWER FEEDING PART
30 IMPEDIMENT
40 DIELECTRIC SUBSTANCE
41 INDUCTOR

The invention claimed is:

1. An antenna comprising:

a circuit board having a ground pattern;

a first antenna element that is made of a conductive metal and that has a first branch element and a second branch element having a shorter electrical length than that of the first branch element; and a second antenna element that is made of a conductive metal and that has a third branch element and a fourth branch element having a shorter electrical length than that of the third branch element;

wherein the first antenna element and the second antenna element are placed in proximity to each other while spaced apart from the ground pattern of the circuit board at a predetermined interval and are electrically connected to a first power feeding part and a second power feeding part placed on the circuit board, by a first matching part and a second matching part;

wherein the antenna has a low coupling circuit that electrically connects a portion of the first antenna element to a portion of the second antenna element, the first matching part to the second matching part, or the first power feeding part to the second power feeding part and that conforms to a plurality of desired frequencies;

wherein, when the plurality of desired frequencies are taken as a first frequency, a second frequency, and a third frequency in ascending order from a low frequency to a higher frequency, the first antenna element and the second antenna element exhibit resonance of a Y12 component of an admittance matrix between the first frequency and the second frequency and between the second frequency and the third frequency;

wherein the first branch element and the third branch element assume a value of nearly a quarter of a resonant electrical length of the Y12 component of the admittance matrix between the first frequency and the second frequency; and wherein the second branch element and the fourth branch element assume a value of nearly a quarter of a resonant electrical length of the Y12 component of the admittance matrix between the second frequency and the third frequency.

2. The antenna according to claim 1, wherein a real part of the Y12 component of the admittance matrix falls within a range from −30 mS to +30 mS at the first frequency, the second frequency, and the third frequency; and an imaginary part of the Y12 component of the admittance matrix increases in sequence of the first frequency, the second frequency, and the third frequency.

3. The antenna according to claim 1, wherein the low coupling circuit has a susceptance value that becomes equal to a value of the imaginary part of the Y12 component of the admittance matrix at the first frequency, the second frequency, and the third frequency; and the low coupling circuit has a function of lessening electromagnetic coupling between the first power feeding part and the second power feeding part.

4. The antenna according to claim 1, wherein there is employed at least one of techniques of providing the first antenna element and the second antenna element with a dielectric substance or a magnetic substance, inserting an inductor to an end or an interior of each of the antenna elements, and providing the first antenna element and the second antenna element with a meandering shape.

5. The antenna according to claim 1, wherein the low coupling circuit is realized by any one of circuit configurations; a single inductor, a single capacitor, a parallel circuit including an inductor and a capacitor, a combination of a serial inductor with a parallel circuit including an inductor and a capacitor, a combination of a parallel circuit including an inductor and a capacitor with a serial capacitor, and a combination of two series-connected parallel circuits, each of which includes an inductor and a capacitor.

6. A portable radio equipped with the antenna defined in claim 1.

* * * * *